US010494977B2

(12) United States Patent
Carter

(10) Patent No.: US 10,494,977 B2
(45) Date of Patent: Dec. 3, 2019

(54) INTERNAL STRAIGHT CORE

(71) Applicant: Reginald Bernard Carter, Houston, TX (US)

(72) Inventor: Reginald Bernard Carter, Houston, TX (US)

( * ) Notice: Subject to any disclaimer, the term of this patent is extended or adjusted under 35 U.S.C. 154(b) by 157 days.

(21) Appl. No.: 15/670,040

(22) Filed: Aug. 7, 2017

(65) Prior Publication Data

US 2019/0040776 A1 Feb. 7, 2019

(51) Int. Cl.
*F01N 13/08* (2010.01)
*F01N 1/08* (2006.01)
*F01N 13/00* (2010.01)

(52) U.S. Cl.
CPC ..... *F01N 13/007* (2013.01); *F01N 1/08* (2013.01); *F01N 1/085* (2013.01)

(58) Field of Classification Search
CPC ..... F01N 1/085; F01N 13/082; F01N 13/007
See application file for complete search history.

(56) References Cited

U.S. PATENT DOCUMENTS 6,089,347 A * 7/2000 Flugger ..... F01N 1/003 181/264
6,367,580 B1 * 4/2002 Chang ..... F01N 1/08 181/219
7,089,731 B1 * 8/2006 Perry ..... F01N 1/18 446/176
2002/0121404 A1 * 9/2002 Storm ..... F01N 1/04 181/228
2009/0283358 A1 * 11/2009 Hughey ..... F01N 1/08 181/264
2009/0313982 A1 * 12/2009 Nishizawa ..... F01N 1/085 60/322
2011/0072807 A1 * 3/2011 Kleinfeld ..... F01N 1/083 60/311
2016/0341083 A1 * 11/2016 Matsunaga ..... F01N 13/082

FOREIGN PATENT DOCUMENTS

WO WO-9535435 A1 * 12/1995 ..... F01N 1/08

OTHER PUBLICATIONS

Exhaust Baffles /Mufflers to Fit 3 inch diameter side pipes MOV247; user: guidoguitar; Youtube.com video; https://www.youtube.com/watch?v=ldfBVES1Lis; accessed Mar. 19, 2019; published Aug. 2, 2014. (Year: 2014).*
Goldwingsdocs motorcycle forum website; "Stainless steel wool for exhaust packing," https://goldwingdocs.com/forum/viewtopic.php?t=23425 7/; Apr. 2015. (Year: 2015).*
DC Sports Muffler Silencer SIL3000; Amazon.com website; https://www.amazon.com/DC-Sports-Muffler-Silencer-SIL3000/dp/B000AURP08/ref=sr_1_1?keywords=dc+sports+muffler+silencer+sil3000&qid=1562350079&s=gateway&sr+32 8-1; Sep. 2008. (Year: 2008).*

* cited by examiner

*Primary Examiner* — Daniel J Colilla
(74) *Attorney, Agent, or Firm* — McKee, Voorhees & Sease, PLC

(57) ABSTRACT

Two end caps with metal straight tubing inserted into a muffler canister, Then affixed to a motorcycle header pipes that's connected to a combustion engine, Particularly a motorcycle engine, Where exhaust gas discharges through both creating more engine performance and sound.

19 Claims, 3 Drawing Sheets

INTERNAL STRAIGHT CORE

BACKGROUND OF INVENTION

The present invention relates to an exhaust system for a motorcycle engine more particularly the invention relates to a internal straight core assembly having a particular arrangement of parts and overall shape.

SUMMARY OF INVENTION

The invention provides a internal straight core assembly for a muffler canister controlling exhaust gas flow from a motorcycle engine, the internal straight core is position inside of muffler canister making a unique sound and performance.

DESCRIPTION OF THE PREFERRED EMBODIMENTS

Figure 1:
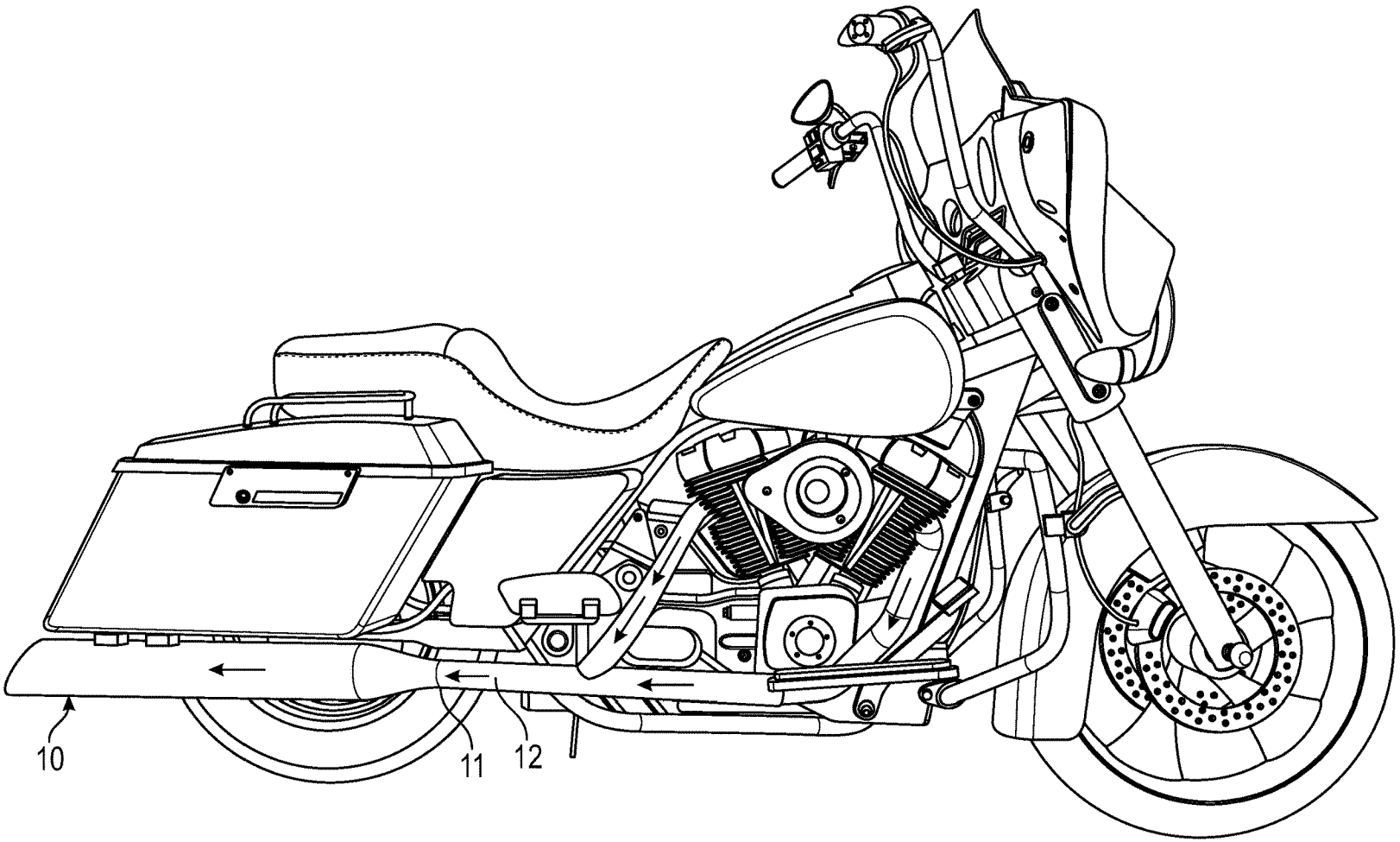
FIG. 1 is a side view of a motorcycle having an exhaust system embodying the present invention.
Figure 2:
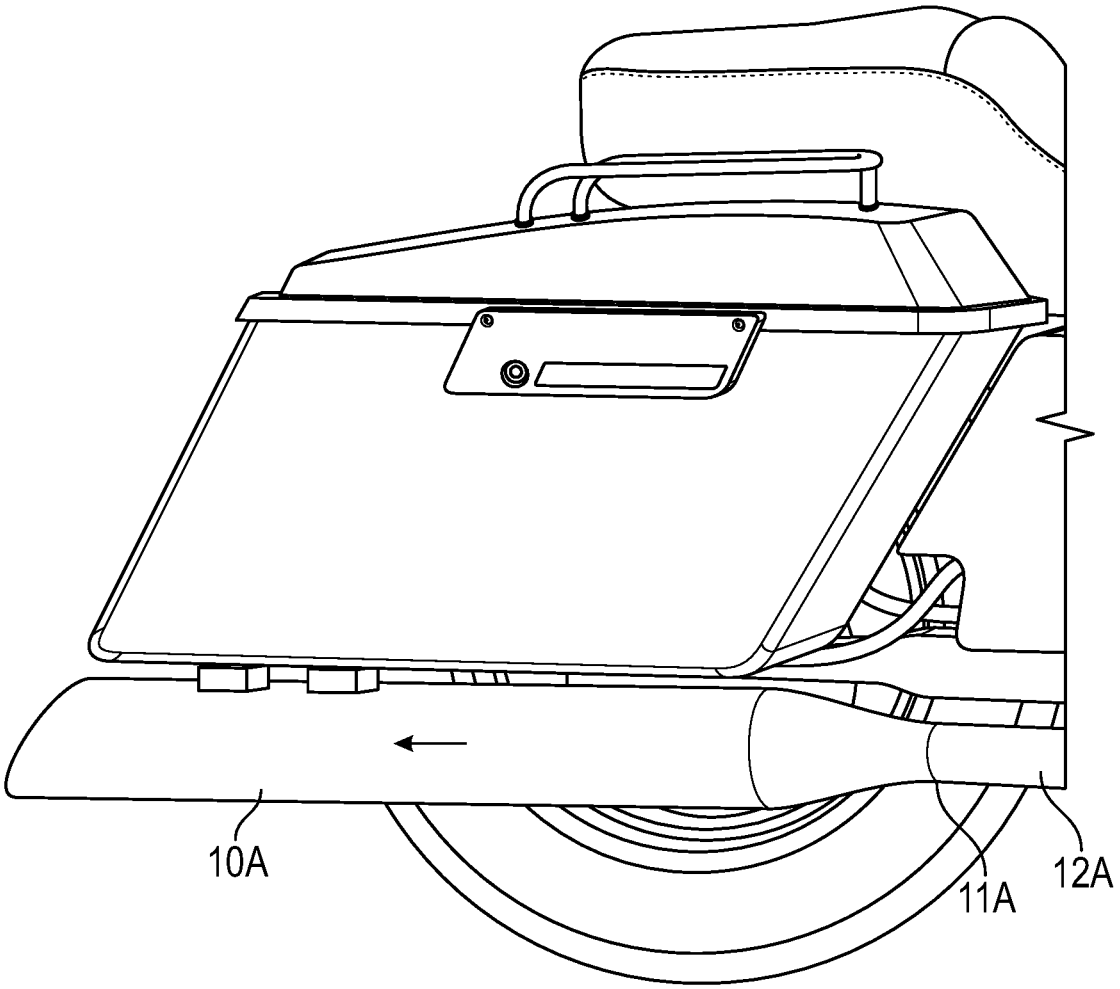
FIG. 2 is a close up view of the exhaust muffler of FIG. 1
Figure 3:
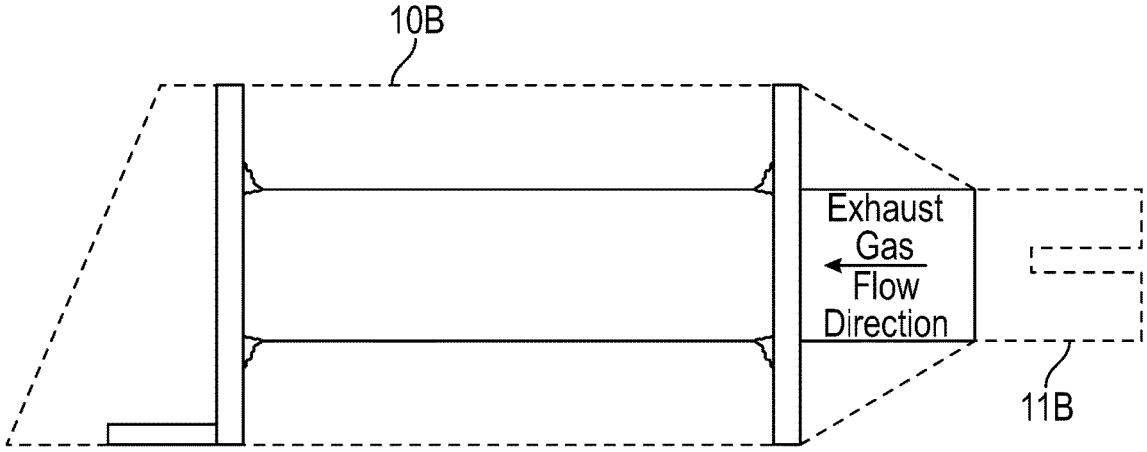
FIG. 3 is a cutaway side view of FIG. 2 showing invention
Figure 4:
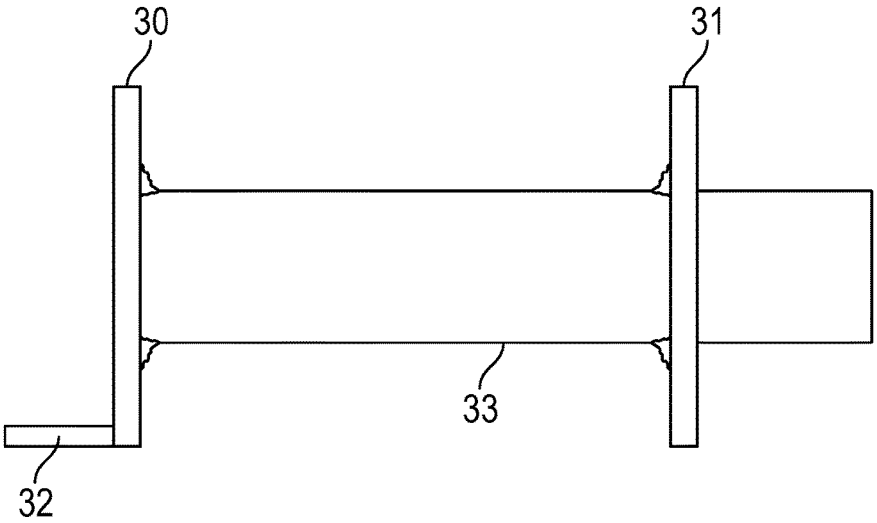
FIG. 4 is an enlarge side view of invention comprising of #30, #31, #32, #33

FIG. 1 illustrates a motorcycle with #10 a muffler canister, #11 canister connect end, connected to #12 motorcycle headers leading to a combusion engine in particular a motorcycle engine FIG. 2 illustrates a motorcycle close upright side view of FIG. 1 a motorcycle showing #10A muffler canister with #11A connect end fastened to #12A motorcycle headers FIG. 3 illustrates a cutaway side view of #10*b* consisting of invention FIG. 4 position inside of #10B muffler canister #30 circular end cap with #32 metal tab, having a circular opening in the center with #33 circular metal tubbing end inserted through it, position to the rear #10B, #31 circular end cap with circular opening in the center with #33 other circular metal tubbing end inserted through it, position toward front of #10*b* near connect end, allowing exhaust gas to flow through invention

I claim:

1. A motorcycle engine exhaust assembly, comprising:

a header connected to an exhaust port of the engine;

a non-perforated, tapered connector extending rearwardly from the header and having a smaller diameter inlet and a larger diameter outlet;

a canister extending rearwardly from the connector outlet;

a non-perforated pipe extending substantially along the length of the canister;

front and back brackets fixed inside the canister; and the pipe extending through the brackets and being fixed thereto such that the pipe and the canister are configured to complete the motorcycle exhaust assembly.

2. The motorcycle engine exhaust assembly of claim 1 further comprising a tab to mount the back bracket inside the canister.

3. The motorcycle engine exhaust assembly of claim 1 wherein the pipe has a diameter substantially the same as a diameter of the header.

4. The motorcycle engine exhaust assembly of claim 1 wherein the pipe is welded to the brackets.

5. The motorcycle engine exhaust assembly of claim 1 wherein the pipe extends inside the connector.

6. The motorcycle engine exhaust assembly of claim 1 wherein the pipe extends substantially along the length of the connector.

7. The motorcycle engine exhaust assembly of claim 1 wherein the pipe is concentric with an axis of the canister.

8. The motorcycle engine exhaust assembly of claim 1 wherein the header, pipe and canister have co-extensive axes.

9. The motorcycle engine exhaust assembly of claim 1 wherein the pipe has a rear end inside the canister.

10. The motorcycle engine exhaust assembly of claim 1 wherein the pipe has a rear end spaced forwardly from a rear end of the canister.

11. The motorcycle engine exhaust assembly of claim 1 wherein the pipe extends rearwardly from the header.

12. The motorcycle engine exhaust assembly of claim 1 wherein the pipe is straight.

13. The motorcycle engine exhaust assembly of claim 1 wherein the brackets are circular plates with central openings through which the pipe extends.

14. A motorcycle muffler, comprising:

a header pipe;

a canister pipe;

the header and canister pipes have different diameters;

a tapered pipe connecting the header and canister pipes;

a straight, non-perforated tube extending centrally through the tapered pipe and the canister;

front and back round plates fixed in the canister and having central openings through which the tube extends; and the tube being welded to the front and back plates so as to be fixed inside the canister pipe, such that the canister pipe and the tube are configured to form a part of a motorcycle exhaust system to control exhaust gas flow.

15. The motorcycle muffler of claim 14 wherein the header and the tube have substantially equal diameters.

16. The motorcycle muffler of claim 14 wherein the header, canister and tube each have an axis, with the axes being co-axial with one another.

17. The motorcycle muffler of claim 14 wherein the back plate is adjacent a rear end of the tube, and the front plate is rearward of a front end of the tube.

18. The motorcycle muffler of claim 14 wherein the tube has a forward end adjacent an outlet end of the header.

19. A motorcycle muffler, comprising:

a header connected to an exhaust port of an engine of a motorcycle;

a tapered connector extending rearwardly from the header and having a smaller diameter inlet and a larger diameter outlet;

a canister extending rearwardly from the connector outlet;

a non-perforated, straight pipe extending from the header, through the connector, and substantially along the length of the canister;

front and back round mounting plates fixed in the canister, and each having a hole through which the pipe extends, with the pipe being welded to the plates so as to fix the pipe within the canister;

a tab to mount the back bracket inside the canister;

the header, canister and pipe having co-extensive axes;

the pipe having a rear outlet spaced forwardly of the rear end of the canister; and wherein the connector, the canister, and the pipe are configured for use in a motorcycle exhaust system for improved engine performance.

* * * * *